US006070279A

United States Patent [19]

Lundstedt

[11] Patent Number: 6,070,279

[45] Date of Patent: Jun. 6, 2000

[54] METHOD AND KIT FOR RETROFITTING A PLUMBED EYEWASH STATION

[75] Inventor: Kurt H. Lundstedt, Hawthorn, Ill.

[73] Assignee: Fendall Company, Arlington Heights, Ill.

[21] Appl. No.: 09/411,458

[22] Filed: Oct. 1, 1999

[51] Int. Cl.[7] ..... A61H 33/00

[52] U.S. Cl. ..... 4/620; 222/105; 239/327; 239/16; 604/294; 604/295; 604/296

[58] Field of Search ..... 4/620; 239/327, 239/16, 273, 99, 379, 562; 222/105; 604/290, 294–296, 297, 300, 302

[56] References Cited

U.S. PATENT DOCUMENTS

| | | | |
|---|---|---|---|
| 3,599,251 | 8/1971 | Wright | 239/16 |
| 4,012,798 | 3/1977 | Liautaud . | |
| 4,363,146 | 12/1982 | Liautaud . | |
| 4,675,924 | 6/1987 | Allison et al. | 4/620 |
| 4,688,276 | 8/1987 | Allison et al. | 4/620 |
| 4,881,283 | 11/1989 | Liautaud . | |
| 5,008,963 | 4/1991 | Stein | 4/620 |
| 5,157,798 | 10/1992 | Van Kammen | 4/620 |
| 5,216,765 | 6/1993 | Paterson et al. | 4/620 |
| 5,262,288 | 11/1993 | Allison | 4/620 |
| 5,381,567 | 1/1995 | Tanner et al. | 4/620 |
| 5,566,406 | 10/1996 | Demeny et al. . | |
| 5,695,124 | 12/1997 | Demeny et al. . | |
| 5,754,990 | 5/1998 | Gurries, II | 4/620 |

FOREIGN PATENT DOCUMENTS

| | | | |
|---|---|---|---|
| 1325509 | 6/1962 | France | 4/620 |
| 2271056 | 6/1962 | United Kingdom | 4/620 |

*Primary Examiner*—Henry J. Recla
*Assistant Examiner*—Khoa D. Huynh
*Attorney, Agent, or Firm*—Jenkens & Gilchrist

[57] ABSTRACT

A kit for retrofitting a plumbed eyewash station is provided. The plumbed eyewash station includes a basin and an outlet pipe mounted within the basin. Prior to retrofitting the plumbed station, the outlet pipe is used to dispense water delivered thereto by a facility's plumbing system. The retrofitting kit includes a nozzle support and a self-contained eyewash fluid delivery system. The fluid delivery system includes a portable container and a nozzle in fluid communication with the container. The portable container contains eyewash fluid. To retrofit the plumbed station, the nozzle support is mounted to the outlet pipe; the portable container is placed on a support surface above the nozzle support; and the nozzle is mounted to the nozzle support. The kit preferably includes an activation door and an actuation strap. The activation door is rotatably mounted to the nozzle support, and the actuation strap extends from the nozzle. During the retrofitting process, the activation door is closed to cover the nozzle, and the actuation strap is fastened to the closed activation door. The retrofitted eyewash station dispenses the eyewash fluid emanating from the portable container instead of from the facility's plumbing system.

25 Claims, 6 Drawing Sheets

METHOD AND KIT FOR RETROFITTING A PLUMBED EYEWASH STATION

FIELD OF THE INVENTION

The present invention relates generally to emergency eyewash stations and, more particularly, relates to a method and kit for retrofitting a plumbed eyewash station. The method and kit converts the plumbed station to a self-contained station that dispenses eyewash fluid emanating from a portable container instead of from a facility's plumbing system.

BACKGROUND OF THE INVENTION

There are a significant number of industrial eyewash sinks connected to a facility's portable water supply. Such eyewash sinks are commonly referred to as plumbed eyewash stations. A vast majority of these eyewash stations are only plumbed into the cold water supply. A new release by the American National Standards Institute (ANSI) for emergency eyewash equipment (ANSI Standard Z358.1-1998), however, recommends that the flushing solution be "tepid," which generally means having a temperature between about 65° F. and 95° F. This temperature range is not achievable with most municipal water supplies. Therefore, a hot water supply line and an appropriate mixing valve must be added to a plumbed station to produce tepid water. In addition, the plumbed stations are prone to the accumulation of harmful bacteria and can become clogged due to rust and scale in the plumbing pipes.

SUMMARY OF THE INVENTION

Accordingly, an object of the present invention is to provide a kit and method for retrofitting existing plumbed eyewash stations so that the retrofitted stations can dispense purified tepid eyewash fluid emanating from a portable container instead of from a facility's plumbing system. Such a retrofitting kit is generally less costly to produce than an entire self-contained eyewash station.

These and other objects are realized by providing a kit for retrofitting a plumbed eyewash station. The plumbed eyewash station includes a basin and an outlet pipe mounted within the basin. Prior to retrofitting the plumbed station, the outlet pipe is used to dispense water delivered thereto by a facility's plumbing system. The retrofitting kit includes a nozzle support and a self-contained eyewash fluid delivery system. The eyewash fluid delivery system includes a portable container and a nozzle in fluid communication with the container. The portable container contains eyewash fluid. To retrofit the plumbed station, the nozzle support is mounted to the outlet pipe; the portable container is placed on a support surface above the nozzle support; and the nozzle is mounted to the nozzle support. The nozzle is switchable from an initial sealed condition in which outlet apertures in the nozzle are blocked to an open condition in which the outlet apertures are exposed. The kit preferably includes an activation door and an actuation strap. The activation door is rotatably mounted to the nozzle support, and the actuation strap extends from the nozzle. During the retrofitting process, the activation door is closed to cover the nozzle, and the actuation strap is fastened to the closed activation door. The retrofitted eyewash station dispenses eyewash fluid emanating from the portable container instead of from the facility's plumbing system.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
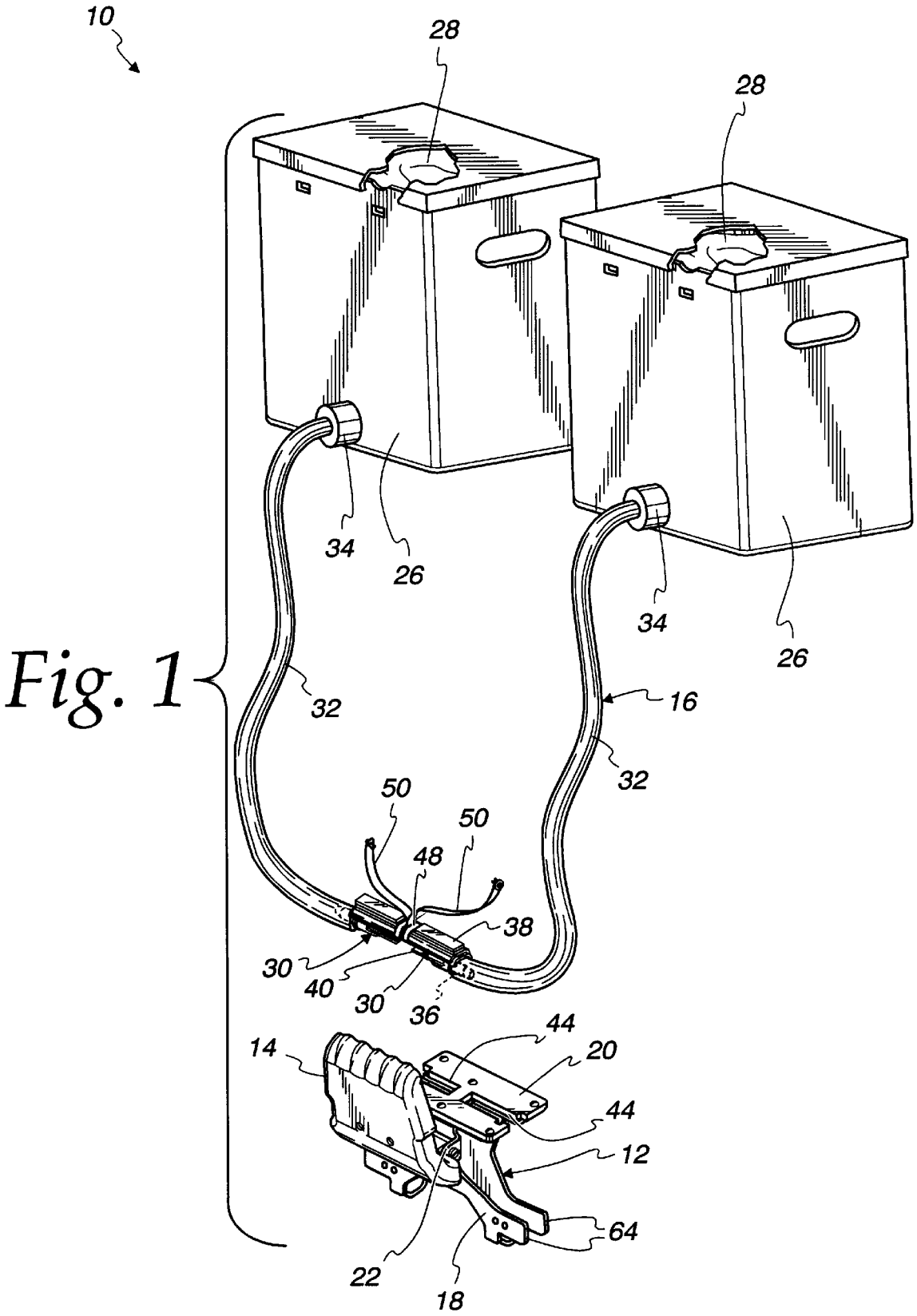
FIG. 1 is a perspective view of a kit for retrofitting a plumbed eyewash station in accordance with the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Turning now to the drawings, FIG. 1 depicts a kit 10 for retrofitting a plumbed eyewash station. The kit 10 includes a nozzle support 12, an activation door 14, and a self-contained eyewash fluid delivery system 16. The nozzle support 12 includes a mounting bracket 18 and a nozzle plate 20 fixedly mounted to a flat upper portion of the bracket 18 by fasteners such as screws, bolts, rivets, or the like. The mounting bracket 18 includes a pair of spaced tabs 22 (one visible in FIG. 1), and the activation door 14 is rotatably mounted to the tabs 22 by fasteners, such as rivets, which allow the door 14 to rotate relative to the tabs 22.

The eyewash fluid delivery system 16 includes a pair of identical delivery arrangements. Each delivery arrangement includes a box 26, a flexible container 28 within the box 26, a nozzle 30, and a flexible hose 32 connecting the nozzle 30 to the flexible container 28. The flexible container 28 is substantially filled with eyewash fluid. The eyewash fluid is preferably a purified fluid such as a buffered isotonic saline solution, although it could be as simple as purified water. An exemplary solution is Eyesaline® solution manufactured by Fendall Company of Arlington Heights, Ill. Alternatively, the purified eyewash fluid may have a special composition directed toward certain types of hazards. The flexible container 28 is preferably a metallized MYLAR™ bag including a layer of polyethylene. The box 26 is preferably composed of corrugated plastic or thick-walled corrugated paperboard. If the box 26 is composed of corrugated paperboard, the paperboard is preferably wax-coated to protect the box 26 against such environmental conditions as humidity. The box 26 includes opposing front and back walls, opposing side walls, and opposing top and bottom walls. In FIG. 1, a portion of the box 26 is cut away to reveal the internal container 28.

The lower portion of the front wall of the box 26 forms a hole sized to accommodate an outlet fitment 34. One end of the flexible hose 32 is firmly connected to this outlet fitment 34. The other end of the flexible hose 32 is firmly connected to an inlet fitment 36 on the nozzle 30. In the preferred embodiment, the hose 32 has an inner diameter of approximately 0.38 inches (0.95 cm).

Figure 6:
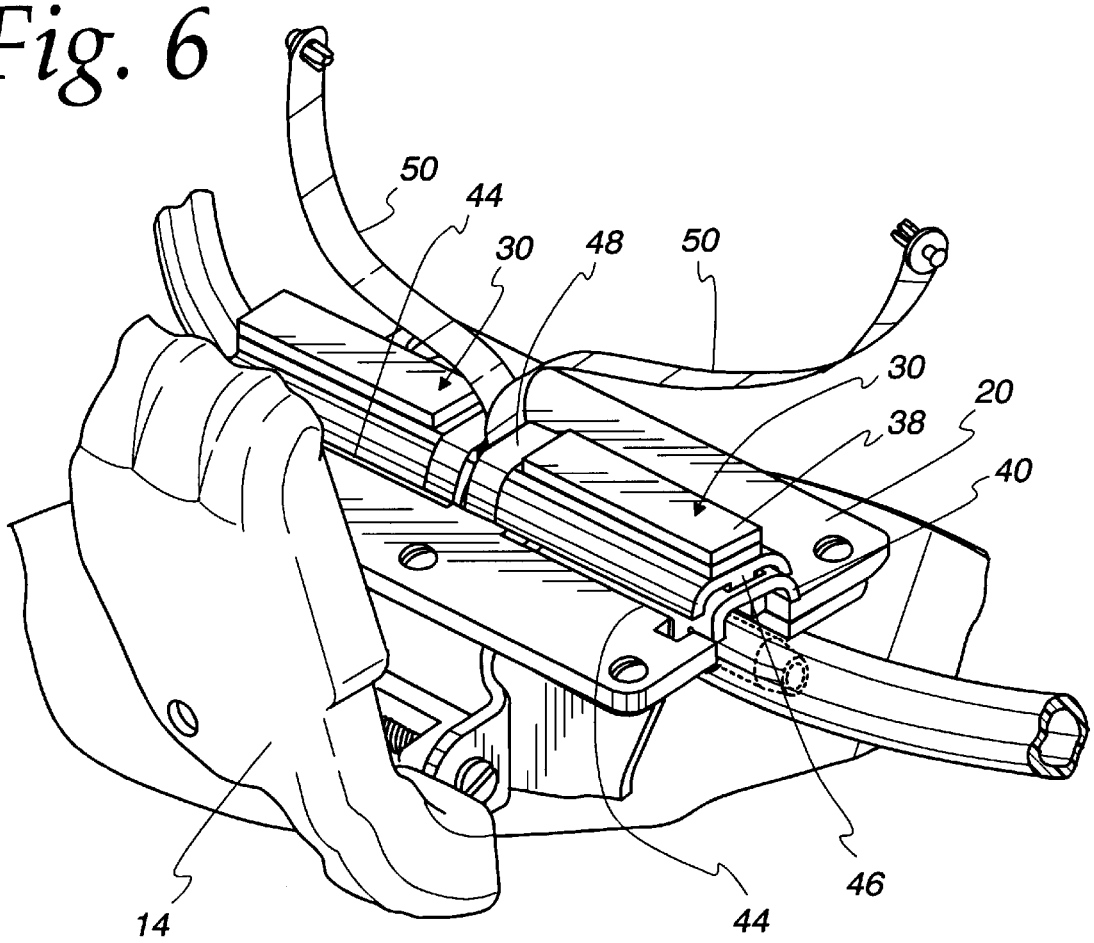
FIG. 6 is similar to FIG. 5 but enlarged to show the connection between the nozzle support and the nozzles of the self-contained eyewash fluid delivery system.
Figure 8:
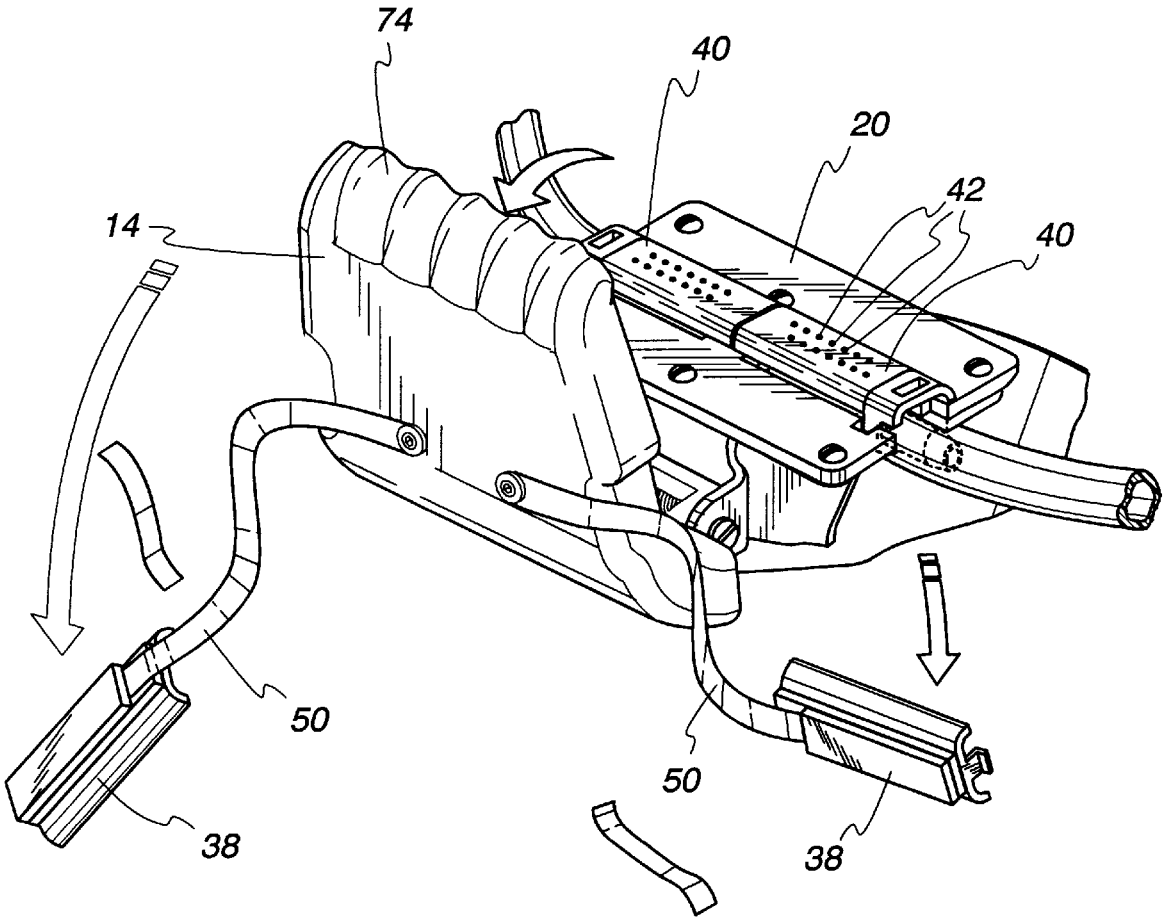
FIG. 8 is a perspective view of the retrofitted eyewash station with the activation door in an open position following activation.

Each nozzle 30 includes an upper pressure plate 38 and a lower nozzle body 40. The lower nozzle body 40 includes the inlet 36 and an elongated array of apertures 42 (FIG. 8). Eyewash fluid entering the inlet 36 is distributed to the apertures via a distribution manifold. The array of apertures in the lower nozzle body 40 preferably includes approximately fourteen apertures arranged in two rows of seven apertures per row (FIG. 8). To permit the nozzles 30 to be slidably mounted to respective elongated slots 44 formed in the nozzle plate 20, opposing sides of each lower nozzle body 40 are grooved. The slots 44 cooperate with the grooved sides formed in each nozzle 30 to slidably engage the nozzles 30 in the respective slots 44 (FIG. 6). This sliding engagement of the nozzles 30 in the respective slots 44 positively locates the nozzles 30 with respect to the nozzle support 12. The width of each slot 44 is approximately the same as the width of each nozzle 30 in the region where they are grooved to create a fairly snug fit therebetween.

As best shown in FIG. 6, the upper pressure plate 38 is hingedly connected to the lower nozzle body 40. In particular, the upper pressure plate 38 forms a retaining tab 46 that is releasably held in a slot formed in the lower nozzle body 40. A seal element, such as a plastic shrink band 48, is used to firmly secure the upper pressure plate 38 to the lower nozzle body 40 such that the upper pressure plate 38 blocks the outlet apertures formed in the lower nozzle body 40. The shrink band 48 tightly circumscribes the nozzle 30 at an opposite end of the nozzle 30 relative to the hinged connection of the pressure plate 38 and nozzle body 40. To hermetically seal the nozzle apertures prior to activation of a retrofitted eyewash station, the upper pressure plate 38 forms an elongated internal pocket that accommodates a rubber gasket. The gasket presses against the apertures to prevent air flow into the apertures and to prevent any possible leakage of the eyewash fluid therefrom.

To permit separation of the upper pressure plate 38 from the lower nozzle body 40, a flexible actuation strap 50, composed of a flexible polymeric material, woven fabric, or the like, is fixedly adhered or mechanically fastened to the upper pressure plate 38. The strap 50 passes beneath the shrink band 48 between the upper surface of the pressure plate 38 and the inner surface of the shrink band 48. The strap 50 is not adhered to the upper surface of the pressure plate 38 in the region beneath the shrink band 48. The manner in which the strap 50 is used to separate the upper pressure plate 38 from the lower nozzle body 40, and thereby permit eyewash fluid to be dispensed from the lower nozzle body 40 via its apertures, is described in detail below.

Until a retrofitted eyewash station is activated, the eyewash fluid delivery system 16 is a hermetically sealed system extending from the flexible containers 28, through the respective hoses 32, to the nozzles 30. This sealed delivery system prevents any contamination of the eyewash fluid passageway formed by the containers 28, the hoses 32, and the nozzles 30. The eyewash fluid in the sealed delivery system is not exposed to the environment. Moreover, the sealed delivery system maintains the stability of the eyewash fluid contained in that fluid passageway for a time period as long as approximately two years. Such long-term stability of the eyewash fluid is advantageous because if the retrofitted eyewash station goes unused, its unused delivery system need not be replaced with a new delivery system for about two years. As a result, the maintenance required by the retrofitted eyewash station during long-term periods of non-use is minimal.

Further information concerning the eyewash fluid delivery system 16 and its activation by the actuation straps 50 and activation door 14 may be obtained from U.S. Pat. No. 5,566,406 to Demeny et al., which is incorporated herein by reference in its entirety.

Figure 2:
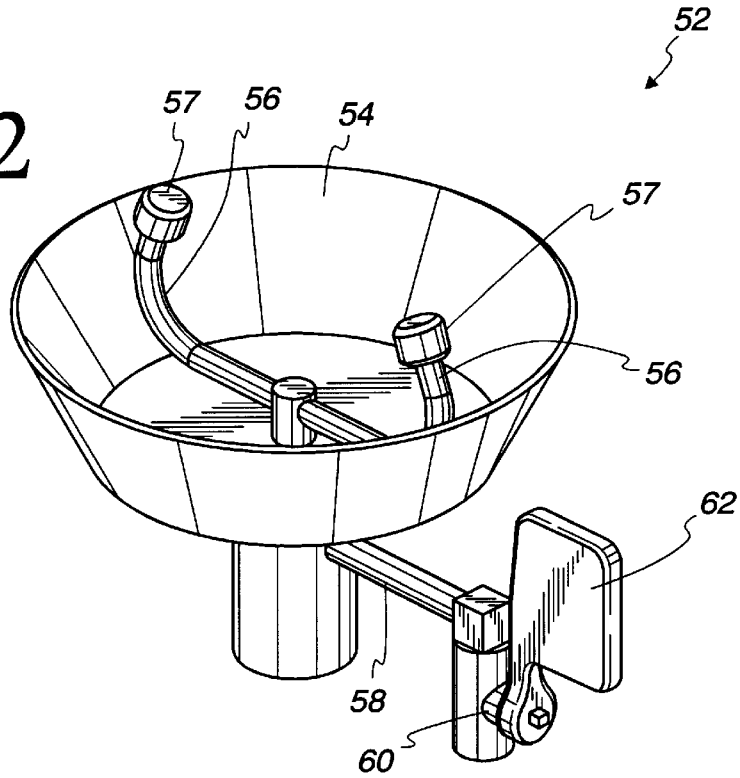
FIG. 2 is a perspective view of a plumbed eyewash station prior to being retrofitted with the kit.

Referring to FIG. 2, there is shown a typical plumbed eyewash station 52 to be retrofitted with the kit in FIG. 1. The plumbed eyewash station 52 includes a basin or sink 54, a pair of outlet pipes 56, an external pipe 58, a valve 60, and a push handle 62 for opening and closing the valve 60. The outlet pipes 56 are mounted within the basin 54 and are typically fitted with respective nozzles 57. When the valve 60 is open, the external pipe 58 conveys water from a facility's plumbing system to the outlet pipes 56.

Figure 3:
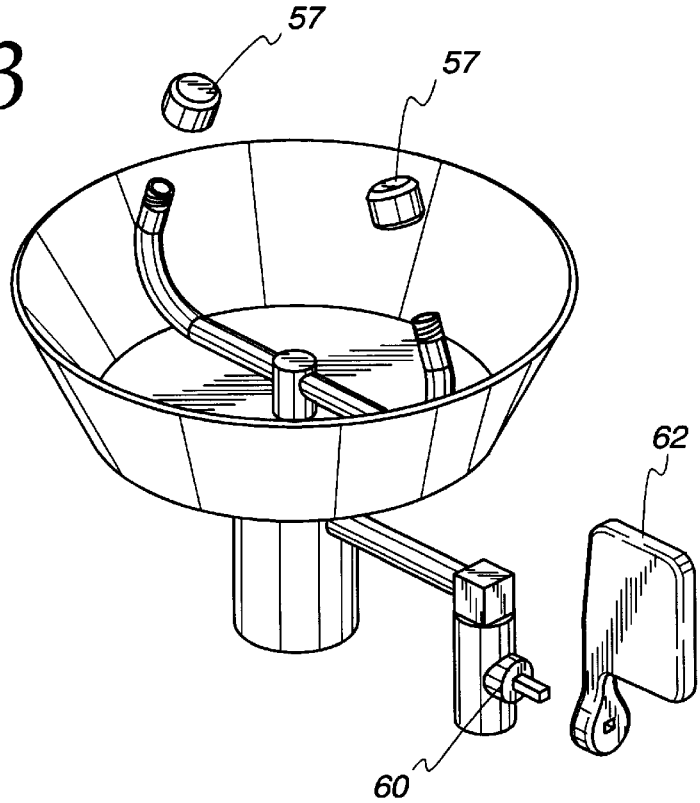
FIG. 3 is a perspective view of the eyewash station prepared to accept the kit.

Referring to FIG. 3, to retrofit the plumbed station, a service technician first detaches the handle 62 from the closed valve 60. Detaching the handle 62 insures that a user of the eyewash station does not inadvertently activate the flow of water from the facility's plumbing system. The eyewash fluid of the retrofitted eyewash station should emanate from the eyewash fluid delivery system 16 (FIG. 1), not the facility's plumbing system. If the nozzles 57 would interfere with any components of the retrofit kit, the service technician also removes the nozzles 57 terminating the respective pipes 56 and optionally replaces the nozzles with plastic caps.

Figure 4:
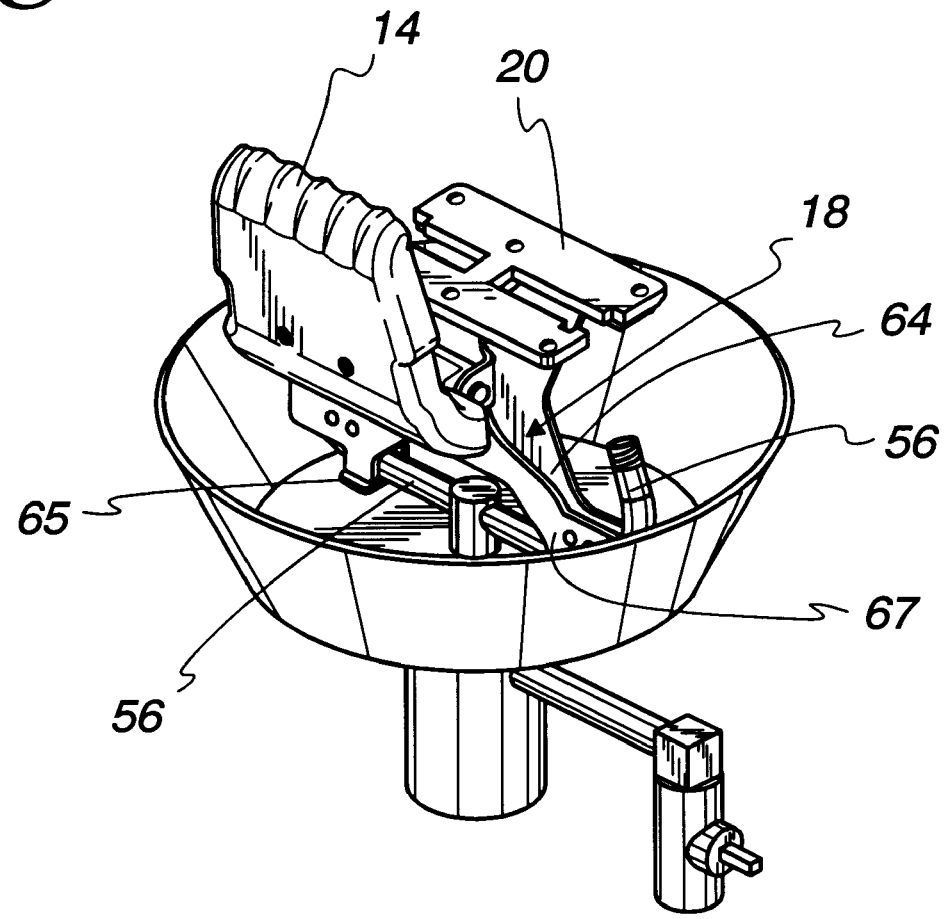
FIG. 4 is a perspective view of the eyewash station retrofitted to include a nozzle support and activation door from the kit.

Referring to FIG. 4, the bracket 18 is clamped to the outlet pipes 56. As shown in FIG. 1, the bracket 18 is pre-assembled to carry the nozzle plate 20 and the activation door 14. The bracket 18 includes a pair of clamping members 64. The clamping members 64 are positioned on opposite sides of the pipes 56, snappingly engaged to each other beneath the pipes 56 at spaced locations 65 and 67, and then secured to each other (with the pipes 56 therebetween) using fasteners disposed immediately above the respective pipes 56. The fasteners are tightened until the clamping members 64 apply sufficient inward pressure to the pipes 56 that the bracket 18 is firmly held in place. The clamping members 64 preferably contain extra fastener holes to allow the bracket 18 to be clamped to different pipe configurations, where some holes are better positioned than other holes.

Figure 5:
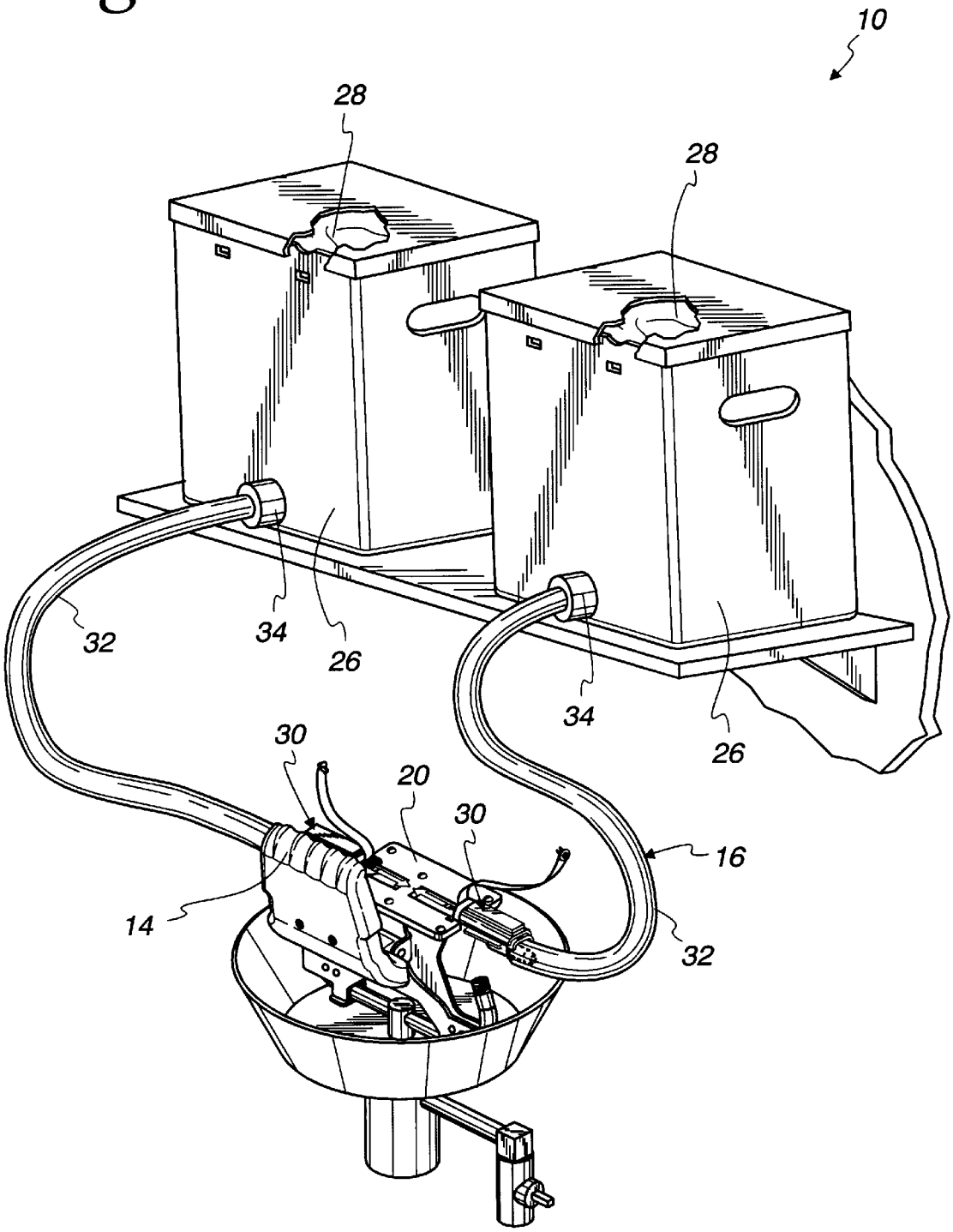
FIG. 5 is a perspective view of the eyewash station further retrofitted to be connected to a self-contained eyewash fluid delivery system.

Referring to FIG. 5, the boxes 26 of the fluid delivery system 16 are placed on a shelf or support 68 mounted to a wall behind the eyewash station. The eyewash fluid in the flexible containers 28 in the respective boxes 26 is fed to the respective nozzles 30 by the force of gravity. Therefore, to meet the ANSI standard recommending that portable eyewash fountains deliver no less than 0.4 gallons per minute (1.5 liters per minute) of eyewash fluid for a time period of 15 minutes, the shelf 68 is positioned such that the bottoms of the boxes 26 are approximately twelve inches above the nozzles 30.

Referring to FIGS. 5 and 6, the nozzles 30 are slidably mounted to the nozzle plate 20. To engage the nozzles 30 in the respective slots 44 of the nozzle plate 20, the nozzles 30 are first positioned adjacent the outermost edges of the respective slots 44 (i.e., left edge of the left slot and right edge of the right slot). Next, with the opposing grooved sides of each nozzle 30 aligned with the opposing elongated edges of each respective slot 44, the nozzles 30 are slid inwardly through the respective slots 44 with the opposing grooved sides of each nozzle 30 slidably receiving the opposing elongated edges of each respective slot 44.

Figure 7:
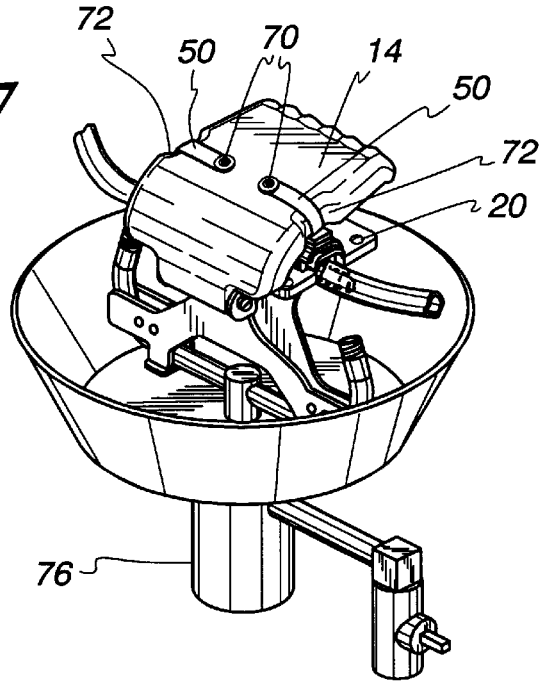
FIG. 7 is a perspective view of the retrofitted eyewash station with the activation door in a closed position so that the eyewash station is ready for activation.

Referring to FIG. 7, after mounting the nozzles 30 to the nozzle plate 20, the activation door 14 is rotated to a closed position. Then, the actuation straps 50 are wrapped around and fastened to the activation door 14 by button-type fasteners 70. The opposing sides of the activation door 14 form notches 72 for locating the respective straps 50. In one embodiment, the fasteners 70 snap into respective holes formed in the activation door 14 slightly inward from the respective locating notches 72. The length of the straps 50 is selected such that the straps 50 are sufficiently slack to avoid placing undue stress on the shrink bands 48 (FIG. 6), and yet are sufficiently taut to fit within the notches 72 formed in the opposing sides of the door 14 so that slippage is not a problem when the eyewash station is activated. The eyewash station is now ready for operation in the event of an emergency requiring a user to flush his or her eyes.

Referring to FIG. 8, in response to an emergency requiring immediate eye flushing, the user opens the activation door 14 by grasping onto its integrally-formed handle 74 and pulling the activation door 14 via the handle 74 to its open position. Opening the activation door 14 activates the flow of the eyewash fluid from the nozzles 30 by pulling the straps 50 relative to the respective nozzles 30. More specifically, opening the activation door 14 pulls each strap 50 in a direction countering the force applied by the associated shrink band 48 (FIG. 6) to the nozzle 30. Pulling the actuation strap 50 first breaks the shrink band 48, and continued pulling of the strap 50 rotates the pressure plate 38 upward about the hinged connection between the pressure plate 38 and the nozzle body 40. As the activation door 14 reaches its open position, the pressure plate 38 is completely separated from the nozzle body 40. When the activation door 14 is in its open position, the pressure plates 38 hang from the activation door 14 by virtue of their attachment to the straps 50 which, in turn, are fastened to the activation door 14. The lower nozzle bodies 40 of the respective nozzles 30 remain mounted to the nozzle plate 20.

With the pressure plates 38 separated from their respective lower nozzle bodies 40, the eyewash fluid from the flexible containers 28 (FIG. 5) is dispensed from the lower nozzle bodies 40 via their apertures. The user flushes his or her eyes by bending over and positioning his or her eyes over the dispensed streams of eyewash fluid. The left eye is flushed with the streams emitted from the left nozzle body, while the right eye is flushed with the streams emitted from the right nozzle body. To prevent the emitted streams from falling back on the apertures in the nozzle bodies 40, the streams are emitted from the lower nozzle bodies 40 at a slight forward angle relative to the vertical direction.

The eyewash fluid dispensed from the nozzles 30 is captured by a drain 76 (FIG. 7) which, in turn, directs the captured eyewash fluid to either a floor or tank beneath the drain 76. The flexible containers 28 (FIG. 5) contain a sufficient volume of the eyewash fluid and are positioned at such a height above the nozzles 30 that the nozzles 30 deliver no less than 0.4 gallons per minute (1.5 liters per minute) of eyewash fluid for a time period of 15 minutes. As stated above, the eyewash fluid is gravity-fed from the containers 28 (FIG. 5) to the nozzles 30.

To prepare the eyewash station for another potential emergency, service personnel clean up and discard any waste fluid, discard the used eyewash fluid delivery system 16, and install a fresh delivery system. Because the procedure for installing the fresh delivery system is described above, it will not be repeated in detail herein. It suffices to state that new boxes 26 holding new flexible containers 28 containing fresh eyewash fluid are placed on the shelf above the eyewash station, and new nozzles 30 are slidably mounted to the nozzle plate 20. Next, the activation door 14 is closed, and new straps 50 extending from the new nozzles 30 are fastened to the activation door 14. The eye wash station is now ready for emergency use.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A kit for retrofitting a plumbed eyewash station, the plumbed eyewash station including a basin and an outlet pipe mounted within the basin, the kit comprising:

a nozzle support adapted to mount to the outlet pipe; and a self-contained eyewash fluid delivery system including a portable container and a nozzle in fluid communication with the container, the portable container containing eyewash fluid, the nozzle being adapted to mount to the nozzle support, the nozzle being switchable from an initial sealed condition in which outlet apertures in the nozzle are blocked to an open condition in which the outlet apertures are exposed.

2. The kit of claim 1, wherein the nozzle includes a nozzle body and a cover releasably connected to the nozzle body, the nozzle body forming the outlet apertures, the cover blocking the outlet apertures when the nozzle is in the initial sealed condition, the cover exposing the outlet apertures when the nozzle is in the open condition.

3. The kit of claim 2, wherein the cover is hingedly coupled to the nozzle body.

4. The kit of claim 2, further including a breakable seal element for initially holding the cover in a position blocking the outlet apertures, the cover exposing the outlet apertures in response to breaking the seal element.

5. The kit of claim 4, further including an actuation strap extending from the cover and adapted to break the seal element in response to being pulled away from the cover.

6. The kit of claim 5, further including an activation door rotatably mounted to the nozzle support for movement between a closed position and an open position, the actuation strap being adapted to fasten to the activation door such that in response to moving the activation door from the closed position to the open position, the actuation strap breaks the seal element and thereby releases the cover from its initial position blocking the outlet apertures.

7. The kit of claim 1, further including an activation door rotatably mounted to the nozzle support.

8. The kit of claim 7, further including an actuation strap extending from the nozzle and adapted to fasten to the activation door.

9. The kit of claim 1, wherein the nozzle support includes a bracket and a nozzle plate, the bracket being adapted to clamp to the outlet pipe, the nozzle plate being mounted to the bracket and forming a slot, the nozzle being adapted to slidably mount to the slot in the nozzle plate.

10. The kit of claim 1, wherein the nozzle support is adapted to clamp to the outlet pipe.

11. The kit of claim 10, wherein the nozzle support forms a slot and the nozzle is adapted to slidably mount to the slot in the nozzle support.

12. A kit for retrofitting a plumbed eyewash station, the plumbed eyewash station including a basin and an outlet pipe mounted within the basin, the kit comprising:

a nozzle support adapted to clamp to the outlet pipe;

an activation door rotatably mounted to the nozzle support; and a self-contained eyewash fluid delivery system including a portable container, a nozzle, and an actuation strap, the nozzle being in fluid communication with the container, the portable container containing eyewash fluid, the nozzle being adapted to mount to the nozzle support, the actuation strap extending from the nozzle and adapted to fasten to the activation door.

13. The kit of claim 12, wherein the nozzle includes a cover initially blocking outlet apertures in the nozzle, the actuation strap extending from the cover.

14. The kit of claim 12, wherein the nozzle support includes a bracket and a nozzle plate, the bracket being adapted to clamp to the outlet pipe, the nozzle plate being mounted to the bracket.

15. A method of retrofitting a plumbed eyewash station, the plumbed eyewash station including a basin and an outlet pipe mounted within the basin, the method comprising:

providing a retrofitting kit including a nozzle support and a self-contained eyewash fluid delivery system, the fluid delivery system including a portable container and a nozzle in fluid communication with the container, the portable container containing eyewash fluid, the nozzle being switchable from an initial sealed condition in which outlet apertures in the nozzle are blocked to an open condition in which the outlet apertures are exposed;

mounting the nozzle support to the outlet pipe;

placing the portable container on a support surface above the nozzle support;

and mounting the nozzle to the nozzle support.

16. The method of claim 15, wherein the eyewash station includes a handle for initiating a flow of water from a facility's plumbing system to the outlet pipe, and further including the step of removing the handle from the eyewash station.

17. The method of claim 15, wherein the step of mounting the nozzle support to the outlet pipe includes clamping the nozzle support to the outlet pipe.

18. The method of claim 17, wherein the nozzle support includes a bracket and a nozzle plate mounted to the bracket, wherein the step of mounting the nozzle support to the outlet pipe includes clamping the bracket to the outlet pipe, and wherein the step of mounting the nozzle to the nozzle support includes slidably mounting the nozzle to a slot in the nozzle plate.

19. The method of claim 15, wherein the step of providing the retrofitting kit includes providing an activation door rotatably mounted to the nozzle support.

20. The method of claim 19, wherein the step of providing the retrofitting kit includes providing an actuation strap extending from the nozzle, and further including the step of fastening the actuation strap to the activation door.

21. The method of claim 20, wherein the activation door is movable between a closed position covering the nozzle and an open position exposing the nozzle, and further including the step of moving the activation door to the closed position prior to the step of fastening the actuation strap to the activation door.

22. A method of retrofitting a plumbed eyewash station, the plumbed eyewash station including a basin and an outlet pipe mounted within the basin, the method comprising:

providing a retrofitting kit including a nozzle support, an activation door, and a self-contained eyewash fluid delivery system, the activation door being rotatably mounted to the nozzle support, the fluid delivery system including a portable container, a nozzle, and an actuation strap, the portable container containing eyewash fluid, the nozzle being in fluid communication with the container, the actuation strap extending from the nozzle;

clamping the nozzle support to the outlet pipe;

placing the portable container on a support surface above the nozzle support;

mounting the nozzle to the nozzle support; and fastening the actuation strap to the activation door.

23. The method of claim 22, wherein the eyewash station includes a handle for initiating a flow of water from a facility's plumbing system to the outlet pipe, and further including the step of removing the handle from the eyewash station.

24. The method of claim 22, wherein the nozzle support includes a bracket and a nozzle plate mounted to the bracket, wherein the step of clamping the nozzle support to the outlet pipe includes clamping the bracket to the outlet pipe, and wherein the step of mounting the nozzle to the nozzle support includes slidably mounting the nozzle to a slot in the nozzle plate.

25. The method of claim 22, wherein the activation door is movable between a closed position covering the nozzle and an open position exposing the nozzle, and further including the step of moving the activation door to the closed position prior to the step of fastening the actuation strap to the activation door.

* * * * *